US006435679B1

(12) United States Patent
Weeks

(10) Patent No.: US 6,435,679 B1
(45) Date of Patent: Aug. 20, 2002

(54) INK JET VALIDATION PRINTER

(75) Inventor: David E. Weeks, Willseyville, NY (US)

(73) Assignee: Transact Technologies, Inc., Wallingford, CT (US)

( * ) Notice: Subject to any disclaimer, the term of this patent is extended or adjusted under 35 U.S.C. 154(b) by 0 days.

(21) Appl. No.: 09/882,467

(22) Filed: Jun. 14, 2001

(51) Int. Cl.[7] ..... B41J 2/01; B41J 13/02
(52) U.S. Cl. ..... 347/104; 400/636; 400/639
(58) Field of Search ..... 347/104, 153; 400/636, 636.3, 639, 642, 605–608

(56) References Cited

U.S. PATENT DOCUMENTS 5,061,095 A 10/1991 Asai et al. ..... 400/605
5,082,384 A 1/1992 Kakaguchi ..... 400/708
5,895,158 A 4/1999 Koyabu et al. ..... 400/605
6,334,723 B1 * 1/2001 Trovinger et al. ..... 400/611
6,298,778 B1 * 10/2001 Onodera et al. ..... 101/232

* cited by examiner

*Primary Examiner*—John Barlow
*Assistant Examiner*—An H. Do
(74) *Attorney, Agent, or Firm*—Wall Marjama & Bilinski LLP

(57) ABSTRACT

An ink jet printer having a drive roller assembly for conducting forms into and out of a printing station that is located beneath the drive roller assembly. A pair of sensor units are mounted above the axis of the drive roller for detecting the alignment and registrations of the leading edge of a form as it enters the nip between the drive roller and a biasing plate prior to initiating a validation sequence. A sensor unit is mounted below the axis of the drive roller for detecting the leading edge of a form as it starts to move out of the nip. The validation sequence is terminated when the trailing edge of the form is detected by the two upper sensors. The printer is arranged to process forms in a lengthwise orientation or a widthwise orientation.

11 Claims, 4 Drawing Sheets

INK JET VALIDATION PRINTER

FIELD OF THE INVENTION

This invention relates generally to the field of validation printers, and specifically to an ink jet validation printer that performs receipt printing as well as validation printing.

BACKGROUND OF THE INVENTION

A validation printer, also known as a cut sheet printer, typically uses a photo sensor to check to see if a form has been inserted into the machine prior to initiating a printing sequence. The photo sensor typically includes a combination of a light emitting element such as a light emitting diode (LED) and a light sensing element such as a photo transistor. When the cut sheet (or form) is set in the printer, the sheet interrupts a light beam emitted from the LED. Interrupting the light beam signals the printer that paper is present for printing. Another method for detecting the presence of a form in the printer includes the use of a microswitch with a detecting lever provided in the paper transport path.

In a dot matrix impact printer, the printer platen moves back to accommodate the thickness of the form when in a validation mode. A sensor reads when the form is inserted, moves the platen section back against the roller, and printing begins. In an ink jet printer, a gap is maintained between the platen and the face of the ink jet cartridge, and, therefore, a traversing mechanism is not needed to move the printer platen back to accommodate the thickness of the form. Instead, a sensor notices the presence of the form and signals the printer to pull the form down into the machine and printing occurs. Printing proceeds line by line, either as the form is pulled down or pushed up by the feed mechanism. Preferably, printing is performed as the form is pulled down so the ink has time to quickly dry before the form moves out of the printing station.

One problem associated with ink jet validation printers of this type, is the inability of the user to insert the form into the printer in proper alignment and registration so that the validation data is printed within a desired location. Sending a form into the printing station in a skewed condition will trigger the sensor to initiate a printing sequence, however, the printed data will be misaligned on the form and, in certain cases, the skewed form may jam the feeding mechanism. By the same token, most ink jet validation printers can only print on a limited part of a form because of the machine's physical limitations, thereby restricting the number of printing applications that can be carried out by the printer.

SUMMARY OF THE INVENTION

Therefore, it is an object of the present invention to improve validation ink jet printers.

It is a further object of the present invention to provide an ink jet printer that is capable of sensing the proper registration and alignment of a form before the form is moved into the printing station.

A still further object of the present invention is to provide an ink jet printer that can validate forms that are fed into the machine in either a lengthwise or a widthwise orientation.

Another object of the present invention is to expand the area on a form that can be imaged by a validation ink jet printer.

These and other objects of the present invention are attained by an ink jet validation printer having a drive roller assembly for conducting forms into and out of a printing station that is located beneath the drive roller assembly. A pair of sensor units are mounted above the axis of the drive roller for detecting the proper alignment and registration of the leading edge of a form as it enters the nip between the drive roller and a biasing plate prior to initiating a validation sequence. A sensor unit mounted below the axis of the drive roller detects the leading edge of the form as the form exits the printing station and signals the termination of the validation sequence to the machine controller. The printer is further arranged to place printed images on forms that are fed into the machine in either a lenghwise orientation or a widthwise orientation.

BRIEF DESCRIPTION OF THE DRAWING

For a better understanding of these and other objects of the present invention, reference will be made to the following detailed description of the invention which is to be read in connection with the accompanying drawing, wherein.

DETAILED DESCRIPTION OF THE INVENTION

Figure 1:
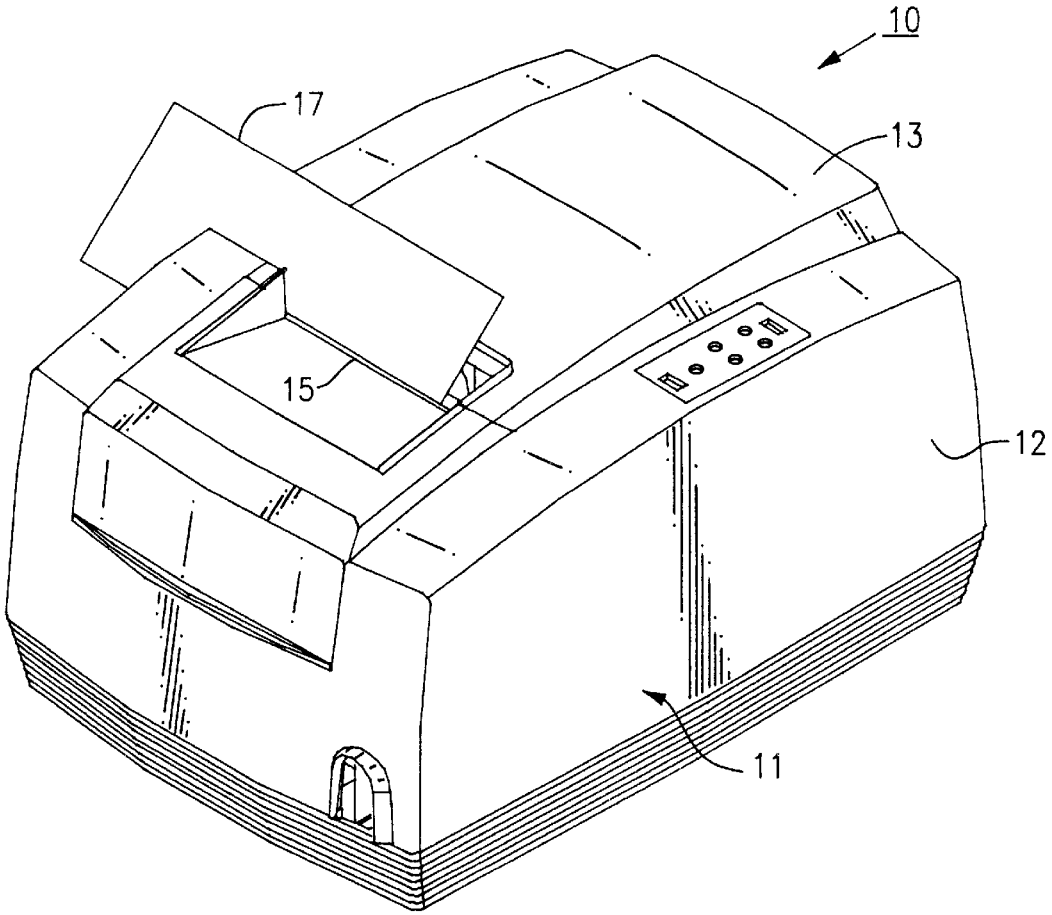
FIG. 1 is a perspective view illustrating a point of sale ink jet printer embodying the present invention.

Turning initially to FIG. 1, there is illustrated a point of sale type printer, generally referenced 10, that embodies the teachings of the present invention. Although the present invention will be described with specific reference to a point of sale printer, it should be evident to one skilled in the art that the present invention has broader application and can be employed in conjunction with many different types of printers without departing from the teachings of the present invention. The printer 10 includes a housing 11 that contains a stationary base section 12 and a removable cover 13 that is hinged at the rear of the base so that the cover can be raised to provide access to the component parts mounted within the base. An elongated slit 15 is provided in the cover and the base section of the printer through which forms can be manually fed into a drive mechanism which will be described in greater detail below for transporting a form into and out of the printing station of the machine. An elongated form 17 is shown situated within the slit. The form illustrated is a check that is being validated while in a plantation or right reading orientation. The term validation is used herein in the broadest sense of the word and can, among other things, include simply printing a notice upon a check that the instrument is for deposit only.

Figure 2:
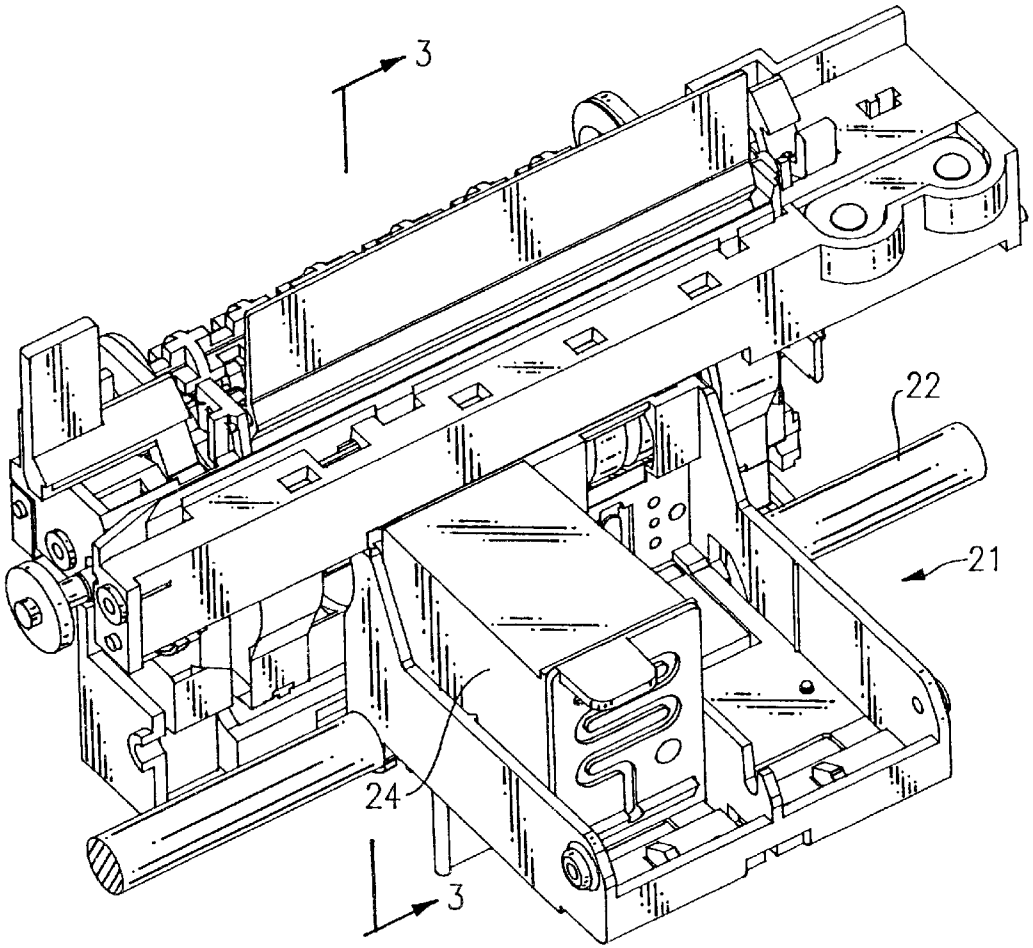
FIG. 2 is an enlarged perspective view illustrating the form feeder mechanism and ink jet cartridge carriage of the printer shown in FIG. 1.
Figure 3:
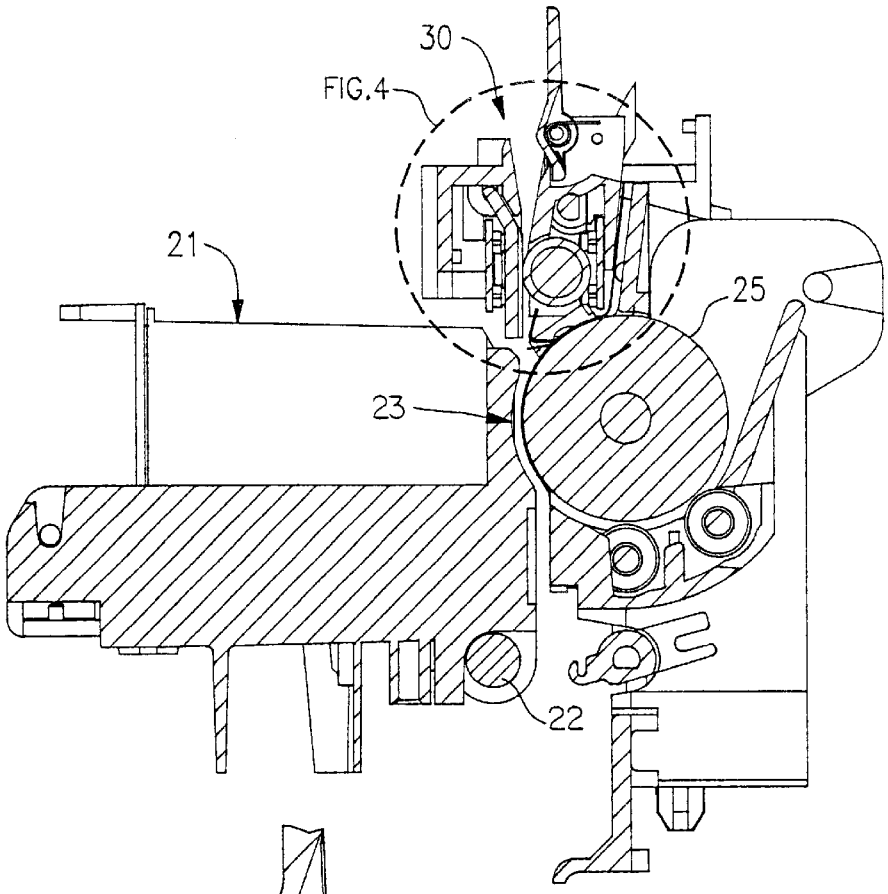
FIG. 3 is a partial enlarged sectional view taken along lines 3—3 in FIG. 2, wherein the ink jet cartridges are removed from the carriage.

As further illustrated in FIGS. 2 and 3, a carriage 21 is arranged to ride along a horizontally disposed rail 22 so that the carriage can be reciprocated within a printing station generally referenced 23. The carriage is arranged to carry two ink jet cartridges 24, one of which is shown mounted within the carriage in FIG. 2. Each ink cartridge is equipped with one or more nozzles that are adapted to apply ink images in the nature of letters or designs upon a form as the form is being transported through the printing station between the ink cartridges and a back-up platen roll 25. This type of ink jet printing is well known in the art and will not be discussed in detail herein except to say that the ink images are preferably laid down in a line by line sequence as the form is moved downwardly or upwardly through the printing station in response to an input from a programmable controller. By printing on the form as it moves downwardly through the printing station, ample time is provided for the ink images to set or dry before the form is withdrawn from the printer.

Figure 4:
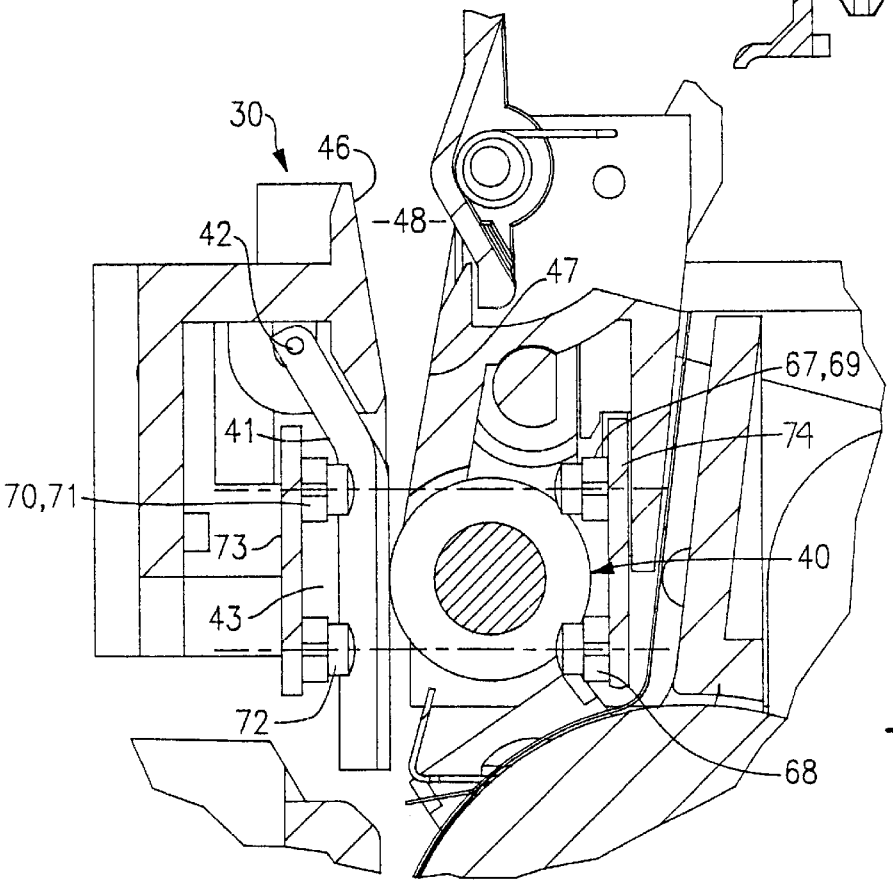
FIG. 4 is a further enlarged sectional view showing the drive mechanism for moving a form into and out of the printing station.
Figure 5:
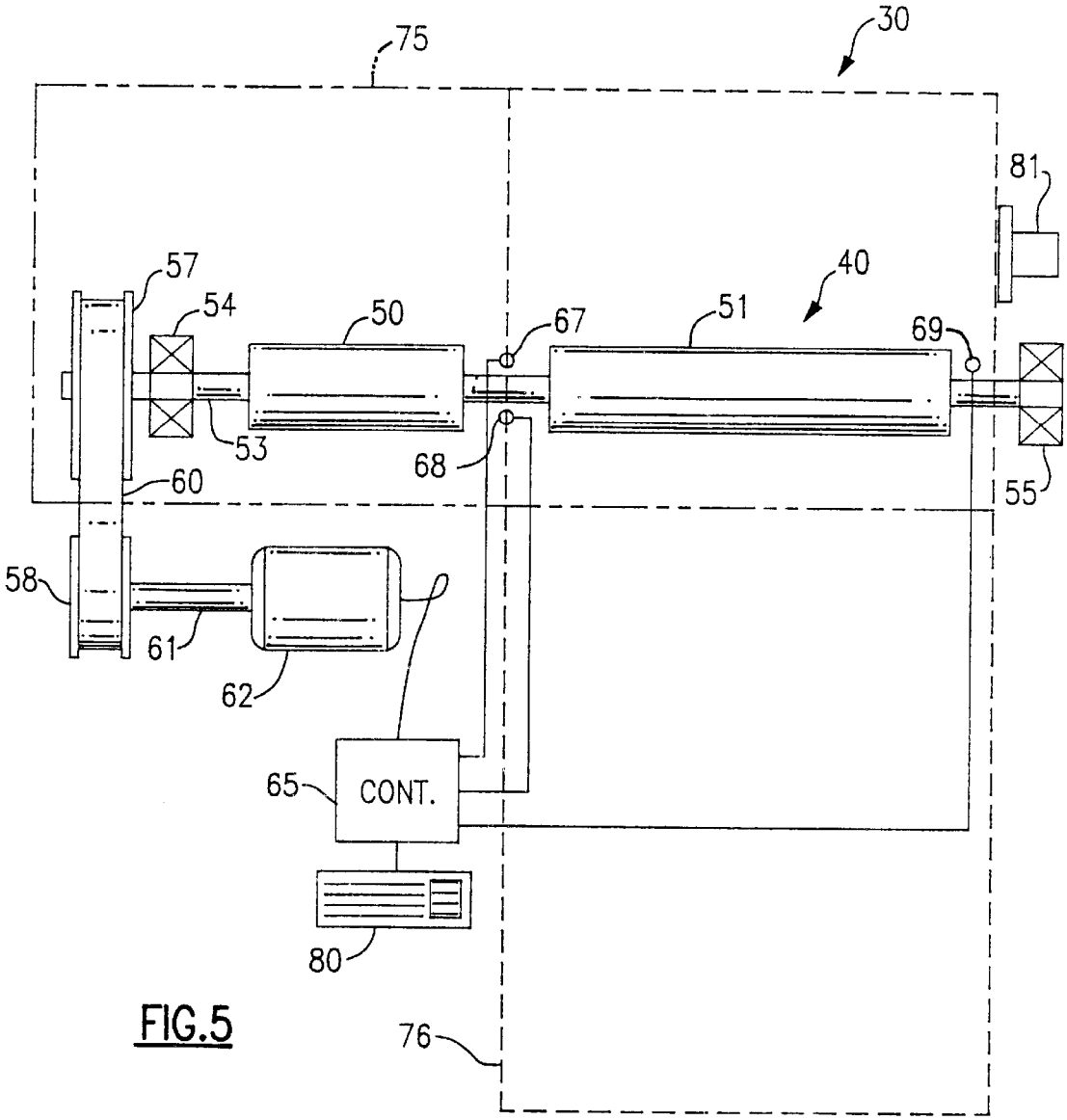
FIG. 5 is a schematic front view of the form drive mechanism and apparatus for controlling the drive roller.

A forms feeder station generally referenced 30 is mounted directly above the printing station and is shown in greater detail in FIGS. 4 and 5. A horizontally disposed drive roller assembly 40 is mounted for rotation within the station and is arranged to act in concert with an opposing biasing plate 41. The plate is pivotally supported upon a pivot pin 42 and is biased toward the drive roller by at least one spring member 43 so that the plate is urged into contact with the drive roller to form a one point nip between the plate and the roller. A pair of canted guide members 46 and 47 are arranged to establish a converging chute 48 at the entrance to the nip. Once in the nip, the form is initially driven in a downward direction as the drive roller turns in counter-clockwise direction as viewed in FIG. 4. Reversing the direction of rotation of the roller will drive the form captured between the drive roller and the biasing plate in an upward direction until such time as the form clears the nip.

As further illustrated in FIG. 5, the drive roller assembly 40 is separated into two sections 50 and 51 that are mounted upon a common shaft 53. The shaft, in turn, is journalled for rotation between spaced apart bearings 54 and 55. One end of the shaft extends outwardly beyond bearing 54 and a timing pulley 57 is secured to the outboard end of the shaft. The pulley 57 is connected to a drive pulley 58 by means of a timing belt 60. The drive pulley, in turn, is secured to the drive shaft 61 of a stepper motor 62, the operation of which is controlled by the programmable controller 65 of the printer.

Drive roller sections 50 and 51 are spaced apart sufficiently to permit light emitting diodes 67 and 68 to be mounted above and below the shaft 53 between the rolling sections. A third light emitting diode 69 is mounted above the shaft at the opposite end of roller section 51. The three light emitting diodes are mounted upon a common circuit board 74 located on one side of the drive roller assembly. Three light detectors (phototransistors) 70–72 are mounted upon a common circuit board 73 situated on the opposite side of the drive roller assembly. Each detector is axially aligned with a light emitting diode to establish a sensor unit. The biasing plate, like the drive roller, is mounted in two sections to provide an uninterrupted light path between the light emitting diodes and the light detectors.

Each detector is connected to the programmable controller 65 of the machine and provides an output signal to the controller when the light path to the detector is broken by a form passing through the nip. Forms may be manually fed into the receiving slot 15 of the machine in either a horizontal orientation as illustrated by form 75 shown in phantom outline in FIG. 5 or in a vertical orientation as illustrated by form 76 shown in dotted outline in FIG. 5. The host or machine operator selects a desired orientation for the form and instructs the controller of the selection and the validation data that is to be printed upon the form. This can be accomplished by means of a keyboard 80 or any other suitable address system known in the art.

A registration stop 81 is mounted within the machine adjacent the form receiving slot 15 against which one edge of the form is registered as the form is moved into the entrance region of the nip. The leading edge of a properly registered form will initially break the beams of light emitted by diodes 67 and 69 at about the same time sending a signal to the controller indicating that the form is properly registered and aligned and is ready to begin a validation sequence. Depending upon the selected form orientation, the controller will step the form downwardly in a line by line progression the required number of lines. This is accomplished by controlling the orientation of the stepper motor which steps the drive roller in coordination with the movement of the ink jet carriage so that the desired data is printed on the form as it moves downwardly in the line by line progression.

When the validation printing sequence is completed, the direction of rotation of the drive roller is reversed and the form is driven in an upward direction to clear the nip. As the trailing edge of the form exits the drive section, the light beam from light emitting diode 68, which has been previously broken by the form, is able to reach detector 72 and the detector provides a signal to the controller telling that the validation sequence has been completed and the system is readied to begin a new validation sequence.

While the present invention has been particularly shown and described with reference to the preferred mode as illustrated in the drawing, it will be understood by one skilled in the art that various changes in detail may be effected therein without departing from the spirit and scope of the invention as defined by the claims.

What is claimed is:

1. An ink jet printer having at least one ink jet cartridge mounted upon a movable carriage located opposite to a platen within a printing station, said printer further including:

a horizontally disposed drive roller assembly mounted above the printing station that is connected to a drive means for rotating said drive roller in either direction, a vertically disposed plate movably mounted opposite said drive roller for guiding a form into said printing station, biasing means for forcing said plate into contact against the drive roller to form a nip therebetween wherein said form that is placed in the nip is driven in a desired direction depending upon the direction of rotation of said drive roller, first and second horizontally aligned spaced apart sensor units mounted above the axis of said drive roller in an entrance region to said nip for detecting the leading edge of said form as it passes into the nip and providing first and second output signals to a programmable controller, said signals being indicative of the alignment of the leading edge of said form with the axis of said drive roller, a third sensor unit mounted below the axis of said drive roller in an exit region to said nip and for detecting the leading edge of said form and providing a third output signal to said programmable controller, that is indicative of said form passing out of said nip, and said programmable controller arranged to determine the alignment of a form in the entrance to said nip and initiate a printing sequence upon the receipt of said first and second output signals and for terminating said sequence upon the receipt of said third output signal from said sensor unit.

2. The ink jet printer of claim 1 wherein said drive roller assembly contains a common drive shaft and a first roller section secured to the drive shaft and a spaced apart second roller section secured to said drive shaft.

3. The ink jet printer of claim 2, wherein said first sensor unit is mounted above the drive shaft within said space between said roller sections and said second sensor unit is mounted above the drive shaft adjacent to the outer end of one of said roller sections.

4. The ink jet printer of claim 3 wherein said third sensor unit is mounted below the drive shaft within the space between the roller sections.

5. The ink jet printer of claim 4 wherein each sensor unit includes a light emitting diode position on one side of said drive roller assembly and a phototransistor positioned on the other side of the drive roller assembly to detect light emitted from said diode.

6. The ink jet printer of claim 5 wherein said light emitting diodes are mounted upon a first circuit board and said photo transistors are mounted upon a second circuit board that is in parallel alignment with said first circuit board.

7. The ink jet printer of claim 2 wherein said shaft is connected to a stepper motor for turning the shaft in either direction.

8. The ink jet printer of claim 7 wherein said stepper motor is controlled by the programmable controller.

9. The apparatus of claim 1 that further includes an input chute for directing a form into said nip.

10. The apparatus of claim 9 wherein said chute converges downwardly from the chute entrance toward said nip.

11. The apparatus of claim 1 wherein said biasing means is a spring.

* * * * *